US006644489B2

(12) United States Patent
Chang

(10) Patent No.: US 6,644,489 B2
(45) Date of Patent: Nov. 11, 2003

(54) CONTAINER ASSEMBLY HAVING A COVER CAP PROVIDED WITH A PUMP MEMBER TO PUMP OUT AIR FROM A CONTAINER

(76) Inventor: Tai-In Chang, 2F, No. 63, Sec. 4, Hsin-I Rd., Taipei City (TW)

( * ) Notice: Subject to any disclaimer, the term of this patent is extended or adjusted under 35 U.S.C. 154(b) by 28 days.

(21) Appl. No.: 10/107,030

(22) Filed: Mar. 27, 2002

(65) Prior Publication Data

US 2003/0183657 A1 Oct. 2, 2003

(51) Int. Cl.[7] ..... B65D 51/16

(52) U.S. Cl. ..... 220/203.01; 220/231; 220/367.1; 215/260; 215/262; 215/311

(58) Field of Search ..... 222/152, 383.1; 141/65; 215/228, 260, 262, 311, 315; 220/202, 203.01, 203.04, 203.07, 203.13, 203.15, 203.16, 203.18, 203.23, 203.27, 203.29, 231, 367.1

(56) References Cited

U.S. PATENT DOCUMENTS 3,135,411 A * 6/1964 Osborne ..... 215/309
5,390,809 A * 2/1995 Lin ..... 220/212
5,546,997 A * 8/1996 Miramon ..... 141/65
5,558,243 A * 9/1996 Chu ..... 220/212
5,564,480 A * 10/1996 Chen ..... 141/65
5,692,632 A * 12/1997 Hsieh et al. ..... 220/212
5,779,082 A * 7/1998 Miramon ..... 220/212

* cited by examiner

*Primary Examiner*—Gene Mancene
*Assistant Examiner*—Patrick Buechner
(74) *Attorney, Agent, or Firm*—Ladas & Parry

(57) ABSTRACT

A container assembly includes a cover cap mounted detachably and sealingly on a container. The cover cap has a pump-mounting wall portion defining a pump-receiving chamber, an inlet formed in the pump-mounting wall portion and in fluid communication with the pump-receiving chamber and a storing space of the container, and a valve-mounting wall portion defining an opening which is in fluid communication with the storing space and the atmosphere. A pump member is disposed movably and sealingly in the pump-receiving chamber, and has an outlet in fluid communication with the pump-receiving chamber and the atmosphere. An urging member urges the pump member away from the inlet. First and second check valves are respectively mounted on the cover cap and the pump member for closing the inlet and the outlet of the pump-receiving chamber, respectively. An air-inlet valve is mounted on the pump member for closing the opening in the cover cap, and is operable to uncover the opening in the cover cap.

3 Claims, 8 Drawing Sheets

CONTAINER ASSEMBLY HAVING A COVER CAP PROVIDED WITH A PUMP MEMBER TO PUMP OUT AIR FROM A CONTAINER

BACKGROUND OF THE INVENTION

1. Field of the Invention

This invention relates to a container assembly, more particularly to a container assembly having a container and a cover cap provided with a pump member to pump out air from the container.

2. Description of the Related Art

A conventional vacuum container assembly generally includes a container that defines a storing space therein and that has a top open end for access into the storing space and a top opening defined by the top open end. A cover cap is mounted on the top open end of the container so as to close the top opening. A separate pump member is used to draw out the air from the storing space in order to preserve the foodstuff stored in the container.

In the conventional vacuum container assembly, since the pump member is normally stored separately when not in use, it tends to be misplaced after use. Moreover, the conventional vacuum container assembly requires both hands of the user to pump out the air from the container.

SUMMARY OF THE INVENTION

The main object of this invention is to provide a container assembly which has a container and a cover cap provided with a pump member to pump out air from the container and which can avoid the aforesaid drawbacks encountered during use of the conventional container assembly.

Accordingly, a container assembly of the present invention includes a hollow casing, a cover cap, a pump member, an urging member, a first check valve, a second check valve, and an air-inlet valve. The casing defines a storing space, and has a top open end and a top opening defined by the top open end for access into the storing space. The cover cap is mounted detachably and sealingly on the top open end of the casing so as to cover the top opening. The cover cap has a pump-mounting wall portion of a U-shaped cross section that defines a pump-receiving chamber, an inlet formed in the pump-mounting wall portion and in fluid communication with the pump-receiving chamber and the storing space, and a valve-mounting wall portion that extends outwardly from the pump-mounting wall portion and that is formed with an opening which is in fluid communication with the storing space and the atmosphere. The pump member is disposed movably and sealingly in the pump-receiving chamber, and is movable toward and away from the inlet so as to vary pressure in the pump-receiving chamber by virtue of change in volume of the pump-receiving chamber. The pump member has an outlet in fluid communication with the pump-receiving chamber and the atmosphere. The urging member urges the pump member away from the inlet. The first check valve is mounted on the cover cap for closing the inlet of the pump-receiving chamber. The inlet is capable of being opened when the pressure in the storing space is greater than that in the pump-receiving chamber, thereby permitting fluid flow from the storing space into the pump-receiving chamber. The inlet is capable of being closed by the first check valve when the pressure in the pump-receiving chamber is greater than that in the storing space upon movement of the pump member toward the inlet against urging action of the urging member. The second check valve is mounted on the pump member for closing the outlet of the pump-receiving chamber. The outlet is capable of being opened when the pressure in the pump-receiving chamber is greater than the atmosphere upon movement of the pump member toward the inlet against the urging action of the urging member, thereby permitting fluid flow from the pump-receiving chamber into the atmosphere. The outlet is capable of being closed by the second check valve and the inlet is capable of being opened when the pressure in the pump-receiving chamber is less than the atmospheric pressure and the pressure in the storing space upon movement of the pump member away from the inlet by virtue of the urging action of the urging member. The air-inlet valve is mounted on the pump member for closing the opening of the cover cap. The air-inlet valve is capable of being manually operable to uncover the opening in the cover cap when desired.

BRIEF DESCRIPTION OF THE DRAWINGS

These and other features and advantages of this invention will become apparent in the following detailed description of the preferred embodiment of this invention, with reference to the accompanying drawings, in which.

DETAILED DESCRIPTION OF THE PREFERRED EMBODIMENT

Figure 1:
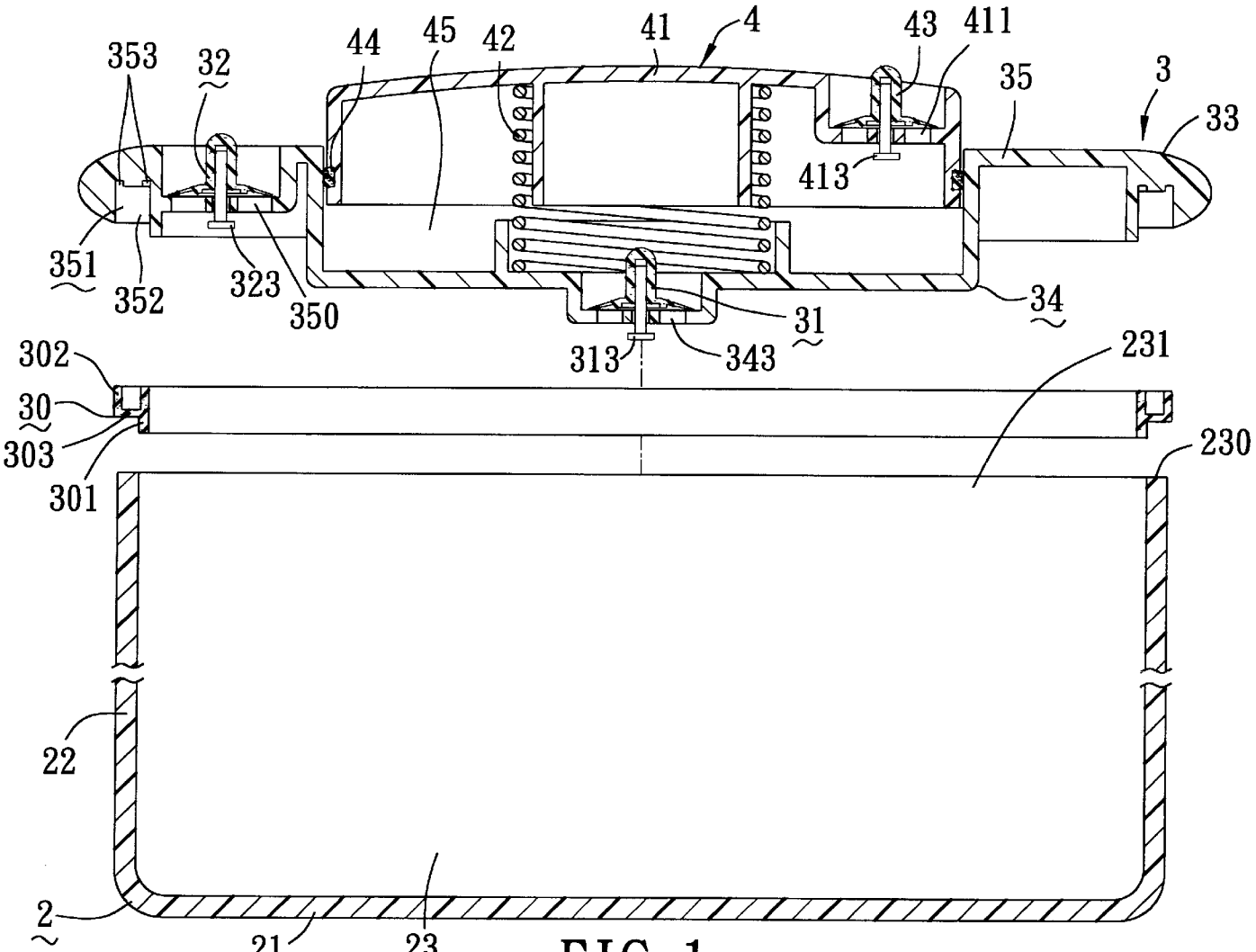
FIG. 1 is an exploded view of a preferred embodiment of a container assembly according to the present invention.

Before the present invention is described in greater detail with reference to the following preferred embodiments, it should be noted that same reference numerals have been used to denote similar elements throughout the specification.

Figure 2:
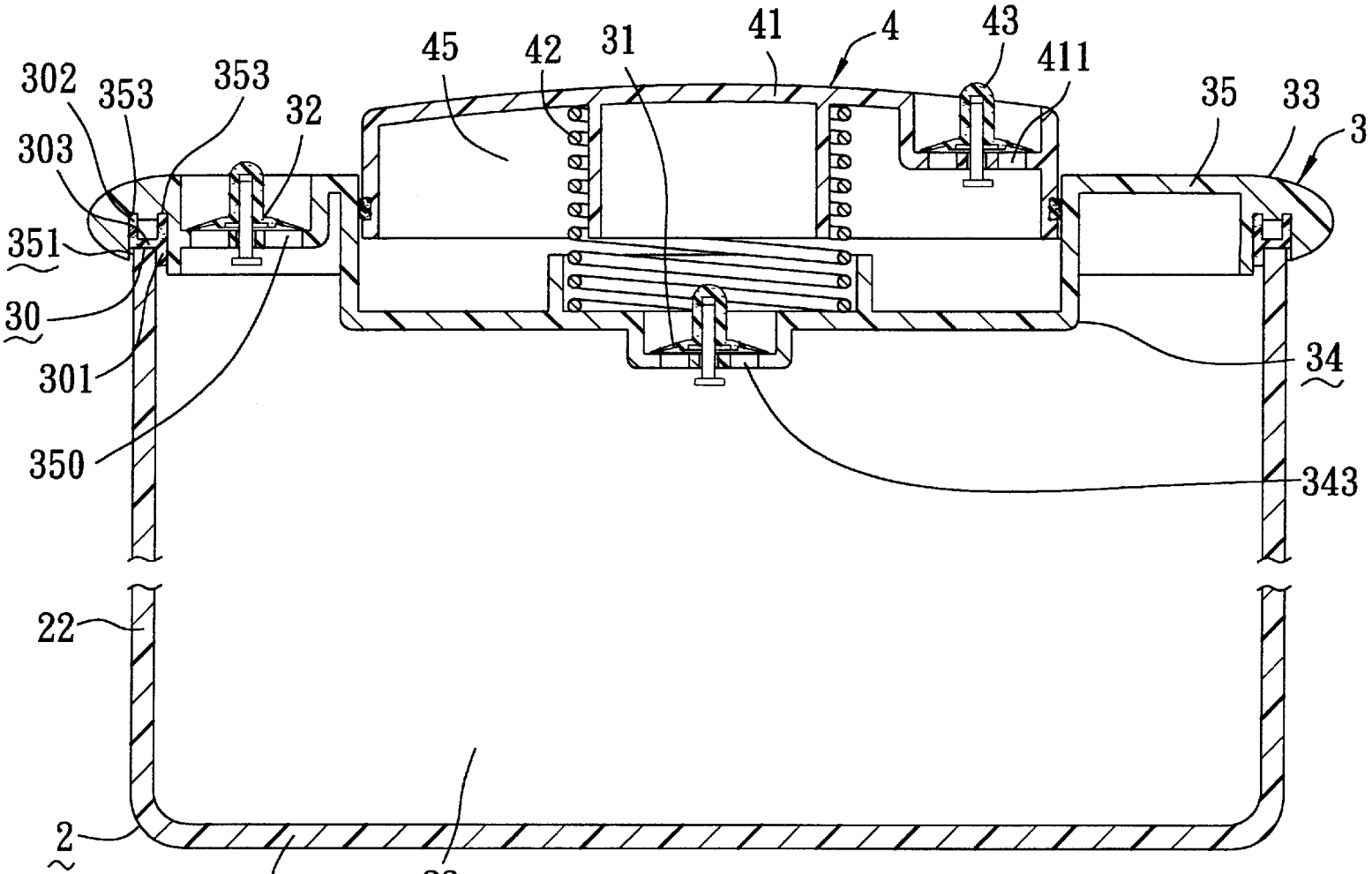
FIG. 2 is a schematic sectional view of the preferred embodiment in a normal state.

Referring to FIGS. 1 and 2, the preferred embodiment of a container assembly according to the present invention is shown to include a hollow casing 2, a cover cap 3, a pump member 4, an urging member 42, a first check valve 31, a second check valve 43, and an air-inlet valve 32.

As illustrated, the casing 2 defines a storing space 23, and has a bottom wall 21, and a peripheral wall 22 that extends upwardly from the bottom wall 21 and that has a top open end 230 and a top opening 231 defined by the top open end 230 for access into the storing space 23.

The cover cap 3 is mounted detachably and sealingly on the top open end 230 of the casing 2 so as to cover the top opening 231. The cover cap 3 has a pump-mounting wall portion 34 of a U-shaped cross section that defines a pump-receiving chamber 45, an inlet 343 formed in the pump-mounting wall portion 34 and in fluid communication with the pump-receiving chamber 45 and the storing space 23, and a valve-mounting wall portion 35 that extends outwardly and radially from the pump-mounting wall portion 34 and that is formed with an opening 350 which is in fluid communication with the storing space 23 and the atmosphere.

The pump member 4 is disposed movably and sealingly in the pump-receiving chamber 45, and is movable toward and away from the inlet 343 so as to vary the pressure in the pump-receiving chamber 45 by virtue of change in volume of the pump-receiving chamber 45. The pump member 4 has an outlet 411 in fluid communication with the pump-receiving chamber 45 and the atmosphere. Preferably, a rubber seal-ring 44 is disposed in an annular groove that is formed in an outer surface of the pump member 4. The seal-ring 44 frictionally and slidably engages an inner surface of the pump-mounting wall portion 34 to provide a leak-proof effect when the pump member 4 moves in the pump-receiving chamber 45.

The urging member 42 is disposed in the pump-receiving chamber 45 for urging the pump member 4 away from the inlet 343 in the pump-mounting wall portion 34.

The first check valve 31 is mounted on the cover cap 3 for closing the inlet 343 in a normal condition. The first check valve 31 is actuated to permit opening of the inlet 343 when the pressure in the storing space 23 is greater than that in the pump-receiving chamber 45, thereby permitting fluid flow from the storing space 23 into the pump-receiving chamber 45 (see FIG. 4). The inlet 343 is capable of being closed by the first check valve 31 when the pressure in the pump-receiving chamber 45 is greater than that in the storing space 23 upon movement of the pump member 4 toward the inlet 343 against the urging action of the urging member 42 (see FIG. 3).

Figure 3:
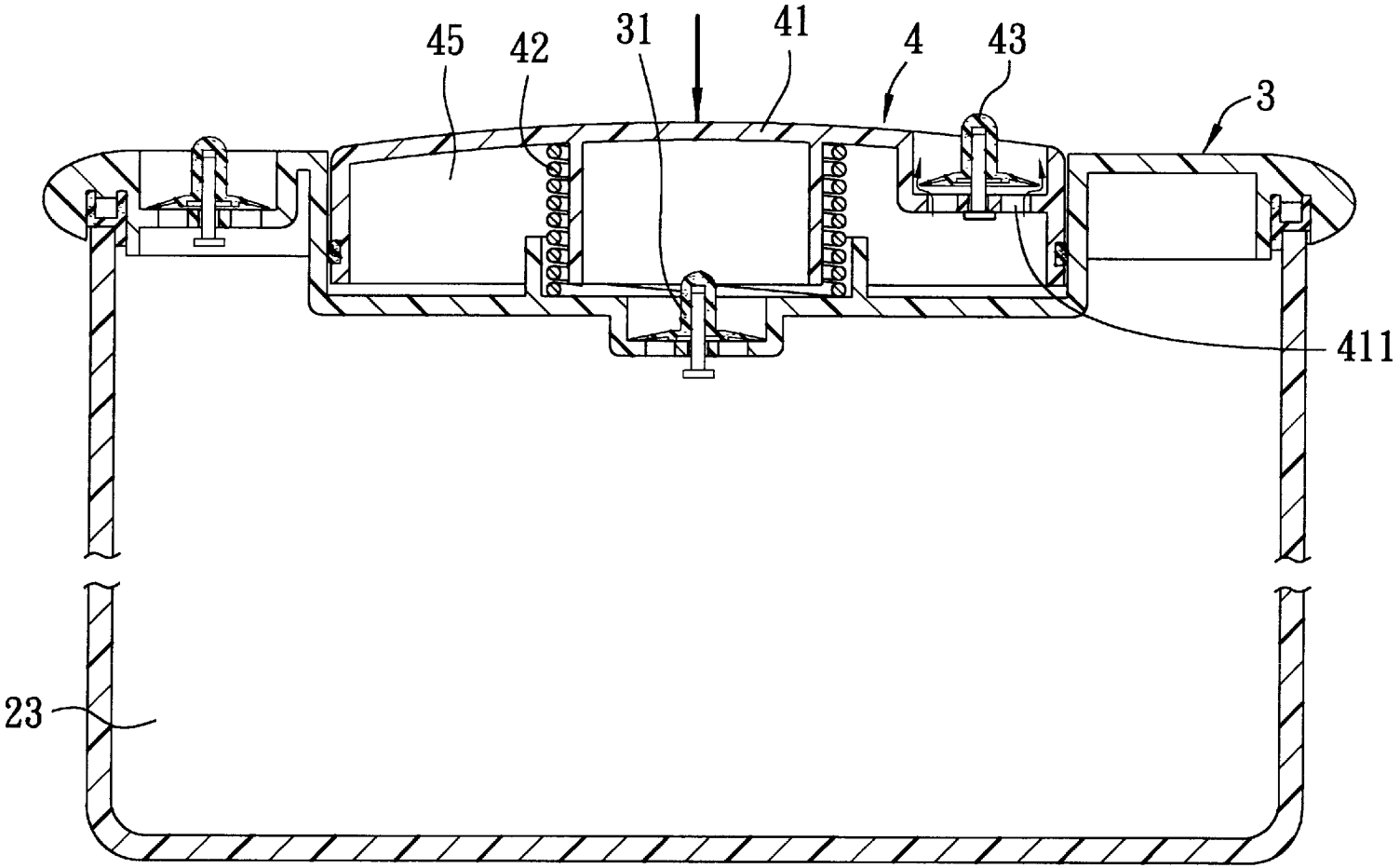
FIG. 3 illustrates how a pump member extends into a pump-receiving chamber of the preferred embodiment when an external force is applied thereto so as to expel air in the pump-receiving chamber into the atmosphere.
Figure 4:
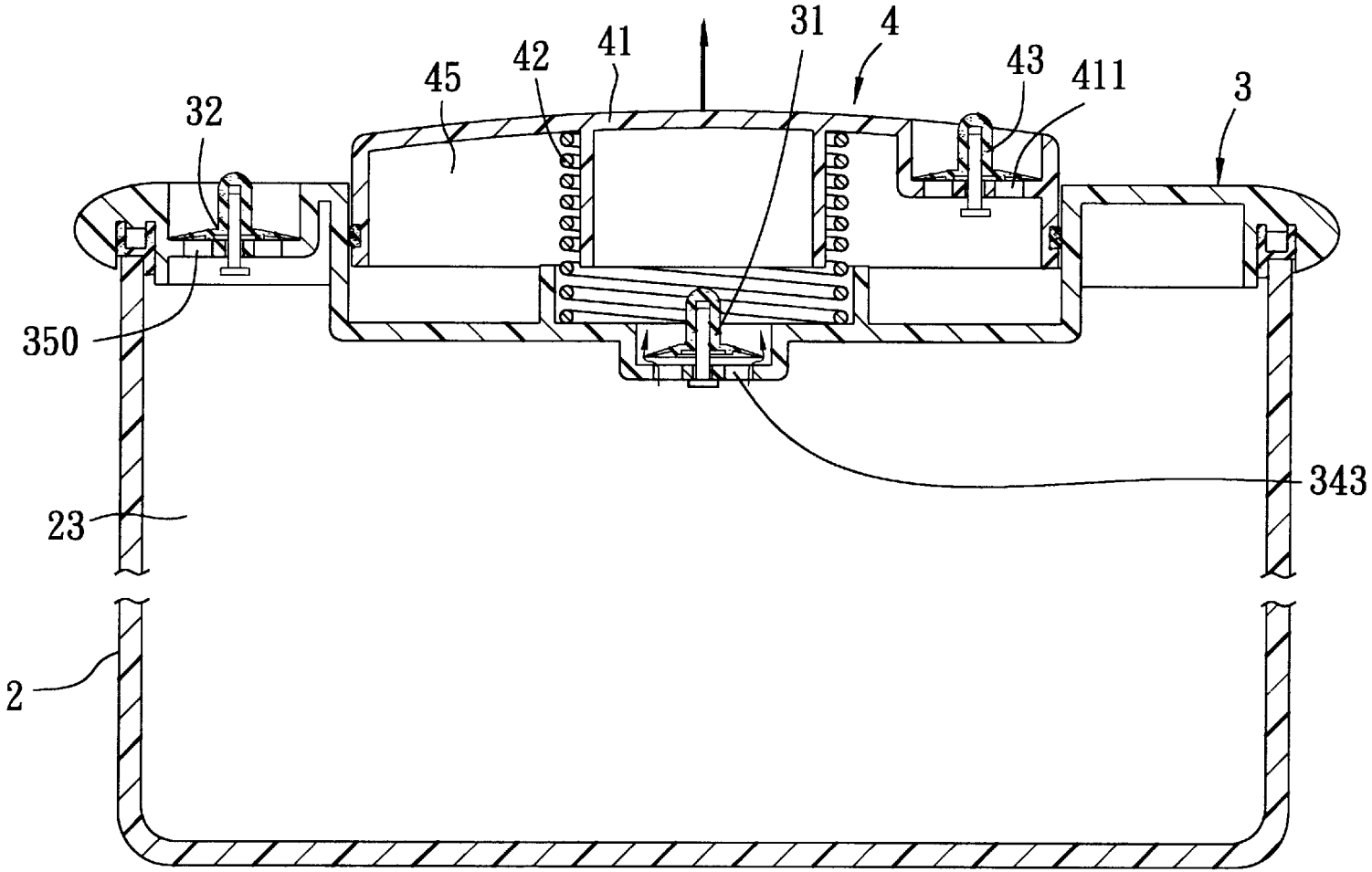
FIG. 4 illustrates how the pump member withdraws outwardly from the pump-receiving chamber of the preferred embodiment upon release of the applied external force so as to draw air from a container into the pump-receiving chamber.

The second check valve 43 is mounted on the pump member 4 for closing the outlet 411. The second check valve 43 is actuated to permit opening of the outlet 411 when the pressure in the pump-receiving chamber 45 is greater than the atmospheric pressure upon movement of the pump member 4 toward the inlet 343 against the urging action of the urging member 42, thereby permitting fluid flow from the pump-receiving chamber 45 into the atmosphere, as best shown in FIG. 3. The outlet 411 is capable of being closed by the second check valve 43 and the inlet 343 is capable of being opened when the pressure in the pump-receiving chamber 45 is less than the atmospheric pressure and the pressure in the storing space 23 upon movement of the pump member 4 away from the inlet 343 by virtue of the urging action of the urging member 42, thereby permitting fluid flow from the storing space 23 into the pump-receiving chamber 45, as best shown in FIG. 4.

Figure 5:
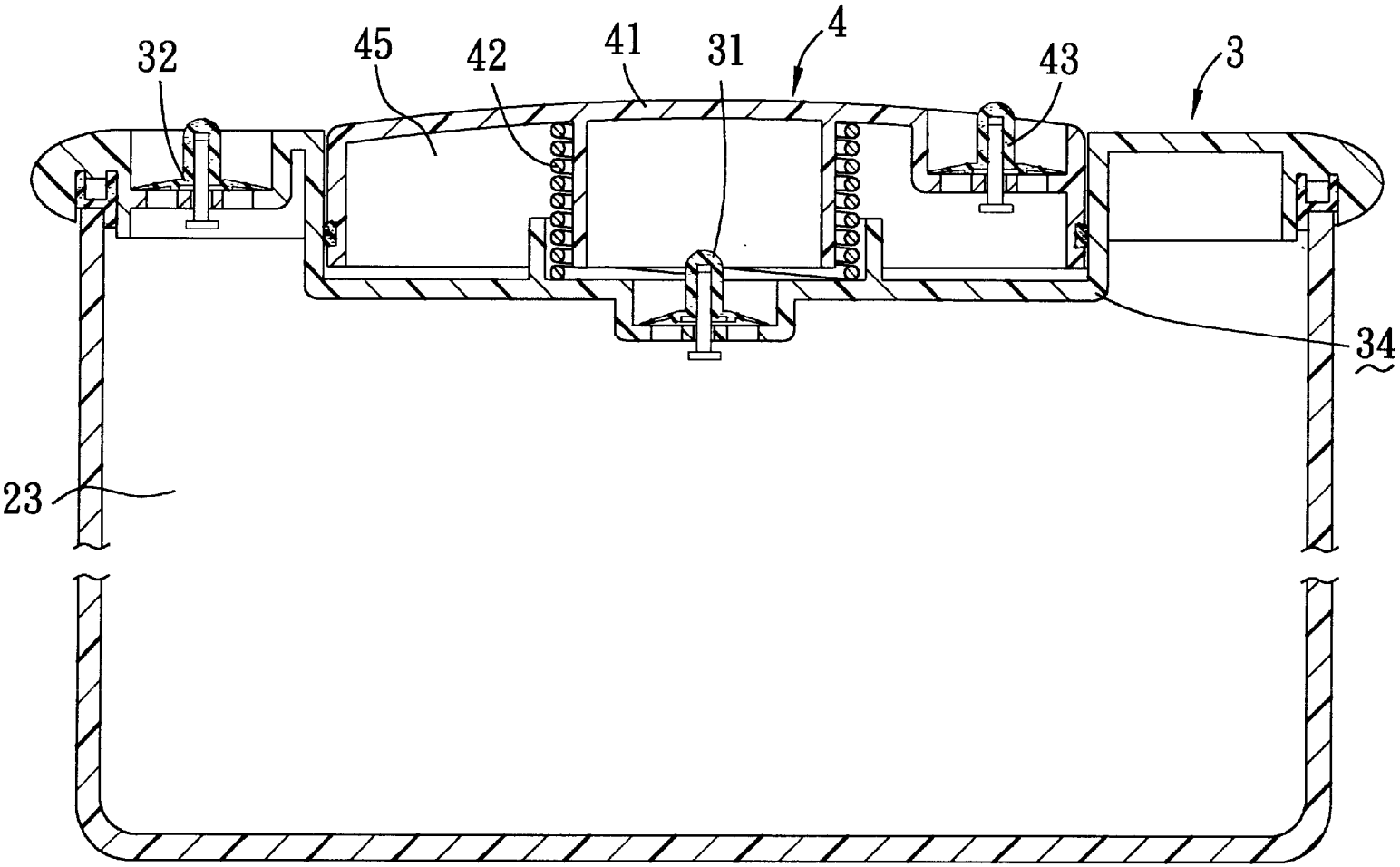
FIG. 5 illustrates the preferred embodiment in a vacuum state.
Figure 6:
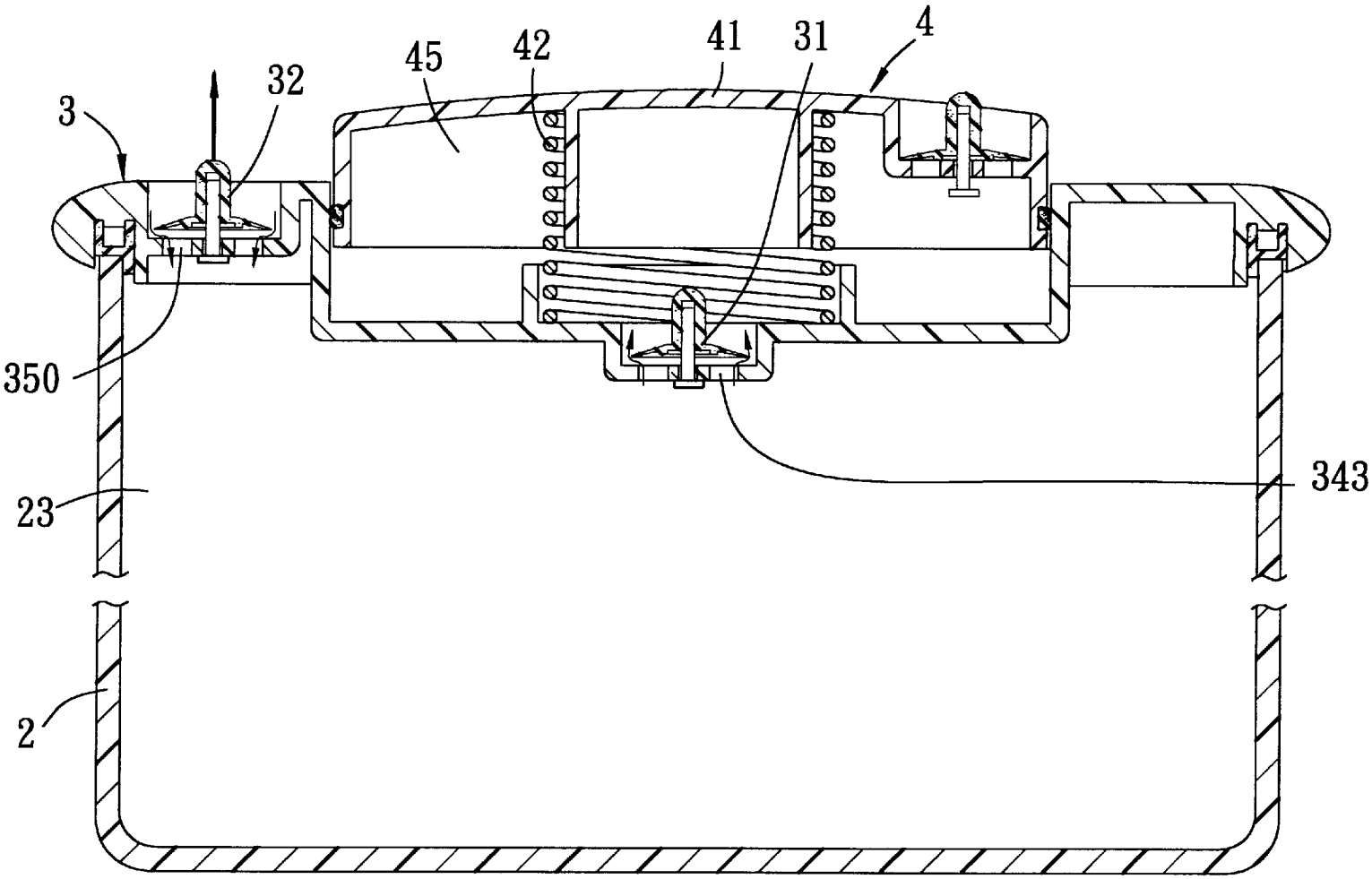
FIG. 6 illustrates how the preferred embodiment returns to the normal state upon actuation of an air-inlet valve mounted thereon.

The air-inlet valve 32 is mounted on the cover cap 3 for closing the opening 350 of the cover cap 3. FIG. 5 shows the pump-receiving chamber 45 and the storing space 23 in a vacuum state, resulting from continued reciprocating movements of the pump member 4 in the pump-receiving chamber 45. In the vacuum state, the urging member 42 is compressed by the atmospheric pressure and the inlet 343 is closed by the first check valve 31. To remove the cover cap 3 from the container 2, the air-inlet valve 32 can be pulled upward away from the opening 350, as best shown in FIG. 6, so as to uncover the opening 350, thereby permitting flow of air from the atmosphere into the storing space 23 of the container 2, which results in actuation of the first check valve 31, opening of the inlet 343, and flow of air from the storing space 23 into the pump-receiving chamber. 45 via the inlet 343. The urging member 42 is subsequently restored from the compressed state to a non-compressed state when the pressure in the pump-receiving chamber 45 together with the urging action of the urging member 42 overcome the atmospheric pressure. Under this condition, the cover cap 3 can be removed with ease from the container 2 when desired.

Referring again to FIGS. 1 and 2, the cover cap 3 has a peripheral wall portion 33 surrounding the valve-mounting wall portion 35 and formed with a downwardly facing annular seal-receiving groove 351 therein which is defined by a groove-confining wall 352. An annular seal member 30 is fitted in the seal-receiving groove 351, and abuts against the top open end 230 of the container 2 so as to establish a hermetically sealing effect between the cover cap 3 and the top open end 230 of the container 2. The seal member 30 preferably has two spaced-apart annular anchoring portions 302 anchored in two retention-slots 353 that are formed in the groove-confining wall 352 of the seal-receiving groove 351, an annular intermediate abutment portion 303 that interconnects lower ends of the anchored portions 302 and that abuts against the top open end 230 of the container 2, and an annular inner portion 301 that projects downward from one of the anchored portions 302 and that abuts against an inner surface of the peripheral wall 22 of the container 2 and the groove-confining wall 352.

Each of the first and second check valves 31, 43 and the air-inlet valve 32 is provided with a mounting post 313, 413, 323 that slidingly and non-removably engages the pump-mounting wall portion 34, the valve-mounting wall portion 35 and the pump member 4, respectively.

Figure 7:
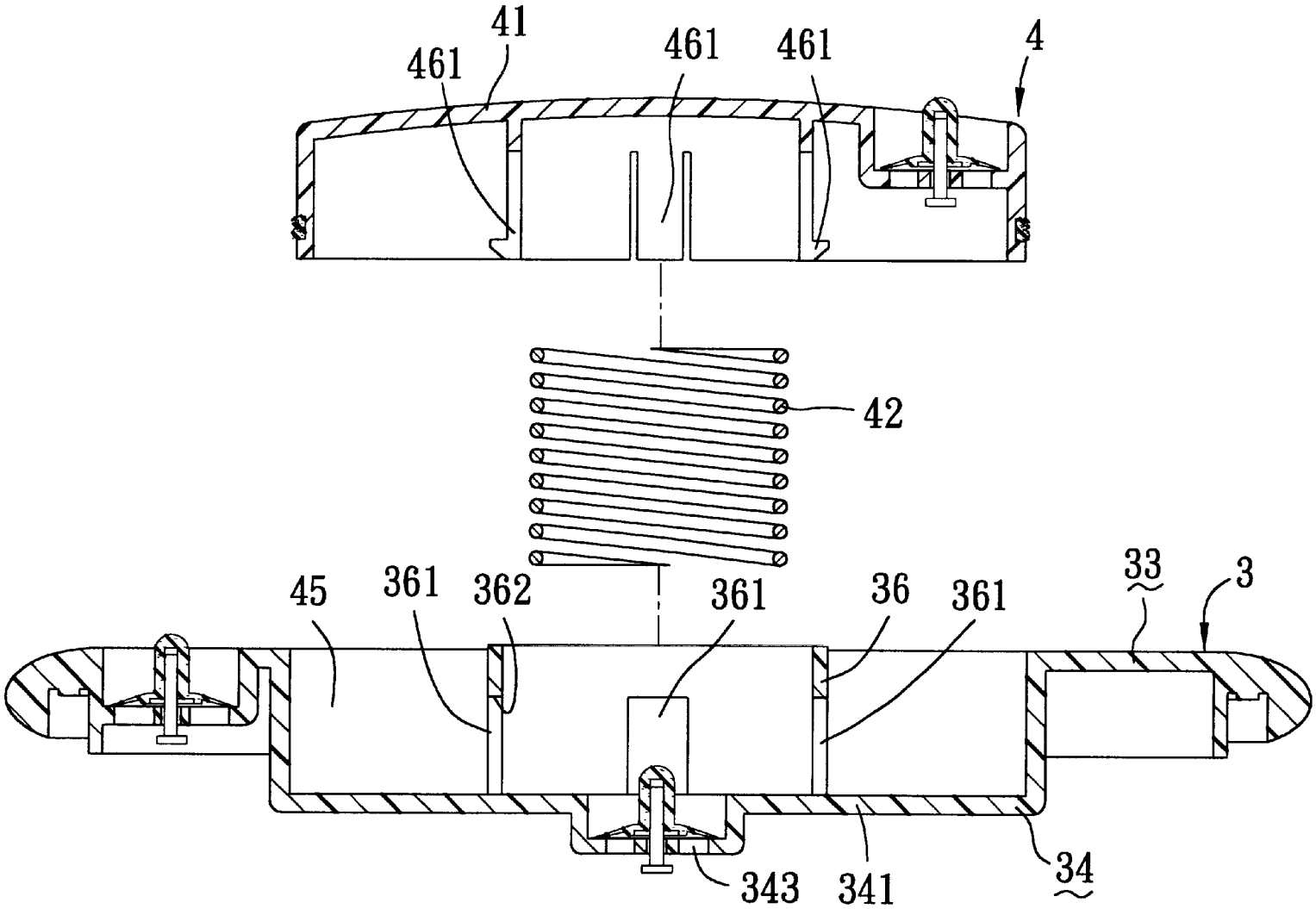
FIG. 7 shows an exploded view of a modified assembly of a cover cap and a pump member for use in the preferred embodiment shown in FIG. 2.
Figure 8:
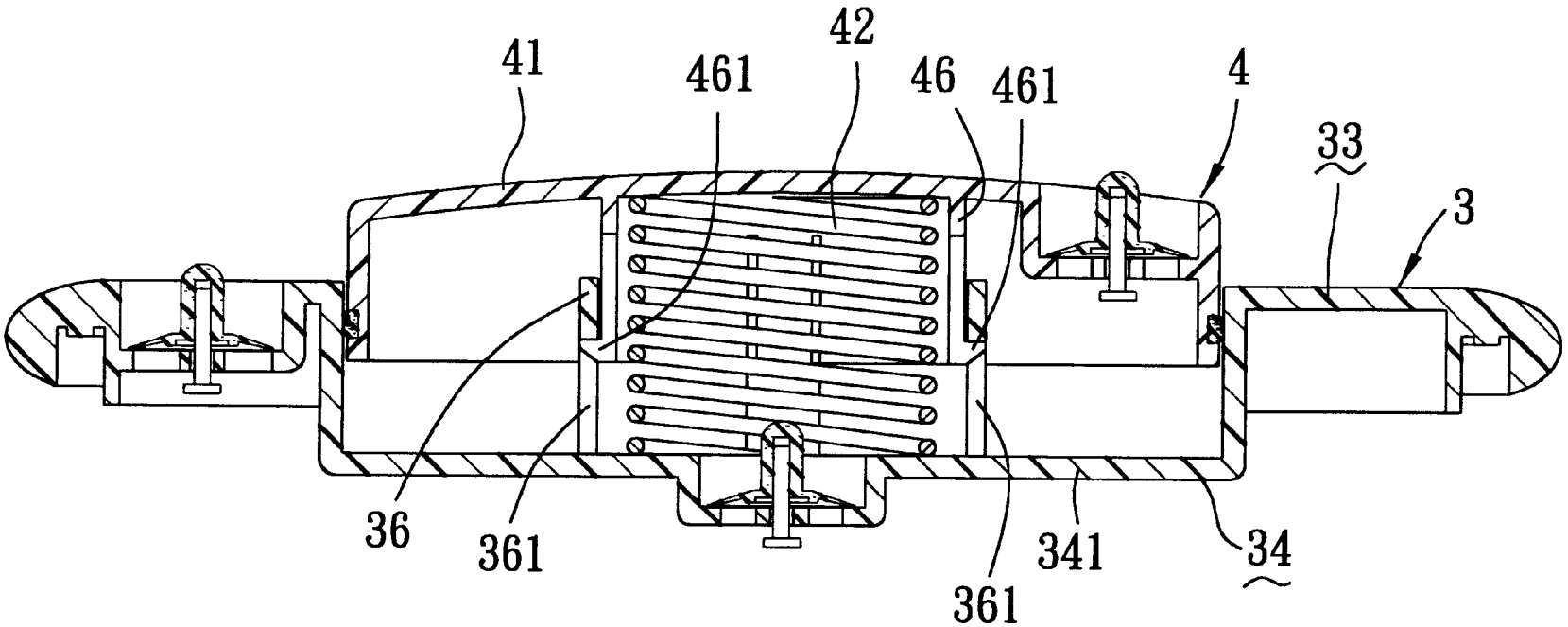
FIG. 8 is a sectional view of the assembly of the cover cap and the pump member for use in the preferred embodiment shown in FIG. 2.

Referring to FIGS. 7 and 8, a modified assembly of the cover cap 3 and the pump member 4 is shown to have a structure similar to that employed in the preferred embodiment. The main difference resides in that, in the modified assembly, the pump-mounting wall portion 34 has a bottom 341 confining a bottom side of the pump-receiving chamber 45. The inlet 343 is formed in the bottom 341 of the pump-mounting wall portion 34. The cover cap 3 further includes an annular wall 36 which is disposed in the pump-receiving chamber 45, which extends upwardly from the bottom 341 of the pump-mounting wall portion 34, and which is formed with a plurality of angularly spaced apart limiting slots 361 therein and a plurality of engaging faces 362 that confine top sides of the limiting slots 361. The pump member 4 has a top wall 41 opposite to the bottom 341 of the pump-mounting wall portion 34 and confining a top side of the pump-receiving chamber 45, and a plurality of angularly spaced apart engaging tongues 461 extending downwardly from the top wall 41 into the limiting slots 361. The engaging tongues 461 engage the engaging faces 362 of the annular wall 36, respectively, when the pump member 4 moves upwardly away from the inlet 343 by virtue of the urging action of the urging member 42 so as to restrict range of movement of the pump member 4 in the pump-receiving chamber 45 and so as to prevent removal of the pump member 4 from the pump-receiving chamber 45.

With this invention thus explained, it is apparent that numerous modifications and variations can be made without departing from the scope and spirit of this invention. It is therefore intended that this invention be limited only as indicated by the appended claims.

I claim:

1. A container assembly comprising:

a hollow casing defining a storing space, and having a top open end and a top opening defined by said top open end for access into said storing space;

a cover cap mounted detachably and sealingly on said top open end of said hollow casing so as to cover said top opening, said cover cap having a pump-mounting wall portion of a U-shaped cross section that defines a pump-receiving chamber, an inlet formed in said pump-mounting wall portion and in fluid communication with said pump-receiving chamber and said storing space, and a valve-mounting wall portion that extends outwardly from said pump-mounting wall portion and that is formed with an opening which is in fluid communication with said storing space and the atmosphere;

a pump member disposed movably and sealingly in said pump-receiving chamber and movable toward and away from said inlet so as to vary pressure in the pump-receiving chamber by virtue of change in volume of said pump-receiving chamber, and having an outlet in fluid communication with said pump-receiving chamber and the atmosphere;

an urging member for urging said pump member away from said inlet;

a first check valve mounted on said cover cap for closing said inlet, said inlet being opened when pressure in said storing space is greater than that in said pump-receiving chamber, thereby permitting fluid flow from said storing space into said pump-receiving chamber, said inlet being closed by said first check valve when the pressure in said pump-receiving chamber is greater than that in said storing space upon movement of said pump member toward said inlet against urging action of said urging member;

a second check valve mounted on said pump member for closing said outlet, said outlet being opened when the pressure in said pump-receiving chamber is greater than the atmospheric pressure upon movement of said pump member toward said inlet against the urging action of said urging member, thereby permitting fluid flow from said pump-receiving chamber into the atmosphere, said outlet being closed by said second check valve and said inlet being opened when the pressure in said pump-receiving chamber is less than the atmospheric pressure and the pressure in said storing space upon movement of said pump member away from said inlet by virtue of the urging action of said urging member; and an air-inlet valve mounted on said cover cap for closing said opening in said cover cap, said air-inlet valve being manually operable to uncover said opening when desired.

2. The container assembly as defined in claim 1, wherein said cover cap has a peripheral wall portion surrounding said valve-mounting wall portion and formed with a downwardly facing seal-receiving groove therein, said container assembly further comprising a seal member that is fitted in said seal-receiving groove and that abuts against said top open end of said container so as to establish a hermetically sealing effect between said cover cap and said top open end of said container.

3. The container assembly as defined in claim 2, wherein said pump-mounting wall portion has a bottom confining a bottom side of said pump-receiving chamber, said inlet being formed in said bottom of said pump-mounting wall portion, said cover cap further including an annular wall which is disposed in said pump-receiving chamber, which extends upwardly from said bottom of said pump-mounting wall portion, and which is formed with a plurality of angularly spaced apart limiting slots therein and a plurality of engaging faces that confine top sides of said limiting slots, said pump member having a top wall opposite to said bottom of said pump-mounting wall portion and confining a top side of said pump-receiving chamber, and a plurality of angularly spaced apart engaging tongues extending downwardly from said top wall into said limiting slots and engaging said engaging faces, respectively, when said pump member moves upwardly away from said inlet so as to restrict range of movement of said pump member in said pump-receiving chamber and so as to prevent removal of said pump member from said pump-receiving chamber.

* * * * *